US005867012A

United States Patent [19]

Tuthill

[11] Patent Number: 5,867,012

[45] Date of Patent: Feb. 2, 1999

[54] SWITCHING BANDGAP REFERENCE CIRCUIT WITH COMPOUNDED $\Delta V_{\beta E}$

[75] Inventor: Michael G. Tuthill, Limerick, Ireland

[73] Assignee: Analog Devices, Inc., Norwood, Mass.

[21] Appl. No.: 907,839

[22] Filed: Aug. 14, 1997

[51] Int. Cl.[6] ..... G05F 3/26

[52] U.S. Cl. ..... 323/313; 323/316

[58] Field of Search ..... 323/312, 313, 323/314, 315, 316; 327/530, 538, 539

[56] References Cited

U.S. PATENT DOCUMENTS

| | | | |
|---|---|---|---|
| 5,352,972 | 10/1994 | Pernici et al. | 323/313 |
| 5,563,504 | 10/1996 | Gilbert et al. | 323/316 |
| 5,686,823 | 11/1997 | Rapp | 323/313 |

*Primary Examiner*—Peter S. Wong
*Assistant Examiner*—Y. J. Han
*Attorney, Agent, or Firm*—Iandiorio & Teska

[57] ABSTRACT

A switching bandgap reference circuit with compounded $\Delta V_{BE}$ includes an amplifier having an output, an inverting input and a non-inverting input; a first PN junction connected to the non-inverting input; a second PN junction connected to the inverting input through an input capacitor; a low current source and a high current source; a switching device for applying in the auto zero mode the low current source to a first terminal of the first PN junction and the high current source to a first terminal of the second PN junction for establishing the $V_{BE}$, of the first junction at both the inputs of the amplifier and for applying in the valid reference mode the high current source to the first terminal of the first PN junction and the low current source to the first terminal of the second PN junction for establishing the positive $\Delta V_{BE}$, of the first PN junction to both the inputs of the amplifier and applying the negative $\Delta V_{BE2}$ of the second PN junction to the input capacitor to produce a voltage of $\Delta V_{BE1}$ plus $(-\Delta V_{BE2})$ across the input capacitor; a feedback capacitor connected between the output and inverting input of the amplifier to define the gain on the combined $\Delta V_{BE}$ voltages to produce a temperature stabilized voltage at the output of the amplifier and a reset switching device for discharging the feedback capacitor and enabling the amplifier to equalize its inputs in the auto zero mode.

9 Claims, 4 Drawing Sheets

SWITCHING BANDGAP REFERENCE CIRCUIT WITH COMPOUNDED $\Delta V_{\beta E}$

FIELD OF INVENTION

This invention relates to a switching bandgap reference circuit with compounded $\Delta V_{BE}$.

BACKGROUND OF INVENTION

Bandgap reference circuits are used to provide a stable reference voltage independent of temperature variation. One continuous time bandgap reference circuit known as a Brokaw cell utilizes two matched bipolar transistors operating at different current densities to develop $V_{BE}$ which decreases with temperature and $\Delta V_{BE}$ which increases with temperature and scales the $\Delta V_{BE}$ with a resistor network to just offset the $V_{BE}$ decrease to produce the stabilized reference voltage. Another continuous time bandgap reference circuit fabricated in CMOS technology makes use of the parasitic substrate bipolar transistors to combine $V_{BE}$ and the offseting $\Delta V_{BE}$ to obtain the temperature stabilized reference output voltage. In the construction the transistors must be matched and the output is a high impedance instead of the operational amplifier of the Brokaw cell. In this construction and in the Brokaw cell the continuous nature of the output makes it difficult to correct the inherent amplifier offset.

In another approach, as disclosed in U.S. Pat. No. 5,563,504, Gilbert et al., a single PN junction is used to develop both the $V_{BE}$ and offsetting $\Delta V_{BE}$ but it is a switching band gap reference circuit which alternates between two modes: the auto-zero mode in which the output voltage is not temperature stabilized and the valid reference mode in which it is. The PN junction is typically a parasitic substrate bipolar transistor in a CMOS circuit. In these circuits the $\Delta V_{BE}$ is relatively quite small which does not help with signal to noise ratio considerations. One way to increase $\Delta V_{BE}$ is to increase the current density ratio but this only aids up to a point due to the logarithmic nature of $\Delta V_{BE}$ with respect to current density. Further, when the current density is increased the ability to match the PN junction becomes more difficult.

SUMMARY OF INVENTION

It is therefore an object of this invention to provide an improved switching bandgap reference circuit.

It is a further object of this invention to provide such a switching bandgap reference circuit which increases the $\Delta V_{BE}$ voltage.

It is a further object of this invention to provide such a switching bandgap reference circuit which has an improved signal to noise ratio.

It is a further object of this invention to provide such a switching bandgap reference circuit which increases $\Delta V_{BE}$ independent of the current density ratio of the PN junction.

It is a further object of this invention to provide such a switching bandgap reference circuit in which the PN junctions need not be matched.

It is a further object of this invention to provide such a switching bandgap reference circuit in which the amplifier offset error and low frequency noise are easily corrected.

The invention results from the realization that an improved switching bandgap reference circuit with increased $\Delta V_{BE}$ can be effected without increasing the current density ratio by developing $\Delta V_{BE}$ voltage across a plurality of PN junctions and summing those $\Delta V_{BE}$ voltages to produce a larger total $\Delta V_{BE}$ voltage at the input to the amplifier to be scaled to the temperature stabilized output voltage by the feedback network of the amplifier.

This invention features a switching bandgap reference circuit with compounded $\Delta V_{BE}$. There is an amplifier having an output, an inverting input and a non-inverting input, a first PN junction connected to the non-inverting input, and a second PN junction connected to the inverting input through an input capacitor. There is a low current source and a high current source. A switching device applies in the auto zero mode the low current source to a first terminal of the first PN junction and the high current source to a first terminal of the second PN junction for establishing the $V_{BE}$, of the first junction at both the inputs of the amplifier and for applying in the valid reference mode the high current source to the first terminal of the first PN junction and the low current source to the first terminal of the second PN junction for establishing the positive $\Delta V_{BE1}$ of the first PN junction to both the inputs of the amplifier and applying the negative $\Delta V_{BE2}$ of the second PN junction to the input capacitor to produce a voltage of $\Delta V_{BE1}$ plus $(-\Delta V_{BE2})$ across the input capacitor. A feedback capacitor is connected between the output and inverting input of the amplifier to define the gain on the combined $\Delta V_{BE}$ voltages to produce a temperature stabilized voltage at the output of the amplifier. A reset switching device discharges the feedback capacitor and enables the amplifier to equalize its inputs in the auto zero mode.

In a preferred embodiment the amplifier may be an operational amplifier, the PN junction may be included in the diode or a transistor, and the transistor may be a bipolar transistor. The PN junction may be included in a parasitic substrate bipolar transistor in a CMOS circuit. The first PN junction may have second terminal connected to a common node to establish the amplifier output voltage relative to that node. The collectors of the transistors may be connected to ground.

DISCLOSURE OF PREFERRED EMBODIMENT

Other objects, features and advantages will occur to those skilled in the art from the following description of a preferred embodiment and the accompanying drawings, in which.

A stable reference voltage is required in many electronic systems and integrated circuits, especially in analog to digital converters where an input voltage is to be measured with respect to a stable voltage and in digital to analog converters where the output voltage is a code-dependent fraction of this reference voltage. This voltage must be generated on-chip and should be independent of temperature.

One well-known technique for generating such a reference voltage is the so-called bandgap reference. This type of circuit utilizes the fact that the base-emitter voltage ($V_{BE}$) of a bipolar transistor decreases with increasing temperature in a well-behaved manner. This behavior is known as CTAT or Complementary-to-Absolute Temperature. If a voltage which is PTAT, or Proportional-to-Absolute-Temperature, is generated and added with the correct scaling to the $V_{BE}$ of the bipolar transistor, then the resulting voltage may be made independent of temperature.

Figure 1:
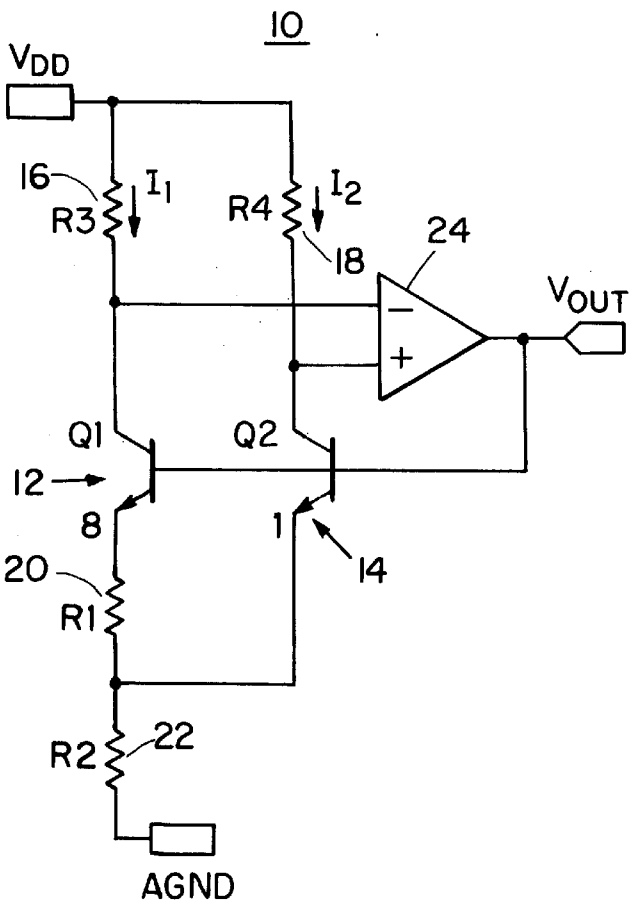
FIG. 1 PRIOR ART
FIG. 1 is a schematic diagram of a prior art Brokaw cell bandgap reference circuit.

FIG. 1 shows one prior art example known as the Brokaw cell 10 to illustrate this technique. In this example, transistors 12 and 14 are operated at equal currents $I_1$, $I_2$ but are of unequal emitter area giving rise to a difference in Base-Emitter voltage which may be written as:

$$\Delta V_{BE}=(kT/q)\cdot 1n(N)$$

and is clearly PTAT as it contains the term T, absolute temperature. N is the current density ratio or in this case the area ratio since the currents are equal. This equality is established by making resistance 16 equal to resistance 18. A value of N=8 is shown which may be achieved by scaling emitter area or, more accurately, by use of multiple devices. This $\Delta V_{BE}$ appears across resistance 20 and determines the operating current of transistor 12 and thereby transistor 14. The sum of these currents flows in resistance 22, developing a voltage which is added to the $V_{BE}$ of transistor 14 and appears at the amplifier 24 output. Thus by proper choice of N, resistance 20 and resistance 22, the output voltage may be chosen such as to be independent of temperature as previously discussed. For more detail see A. Paul Brokaw, "A Simple Three Terminal Bandgap Reference", *IEEE J. Solid-State Circuits,* Vol. SC9, pp. 288–393, Dec. 1994.

Two problems exist with this circuit, firstly isolated bipolar transistors are required and so the circuit cannot be implemented in a low cost CMOS process and secondly good $V_{BE}$ matching is required between two transistors operating at different current densities.

Figure 2:
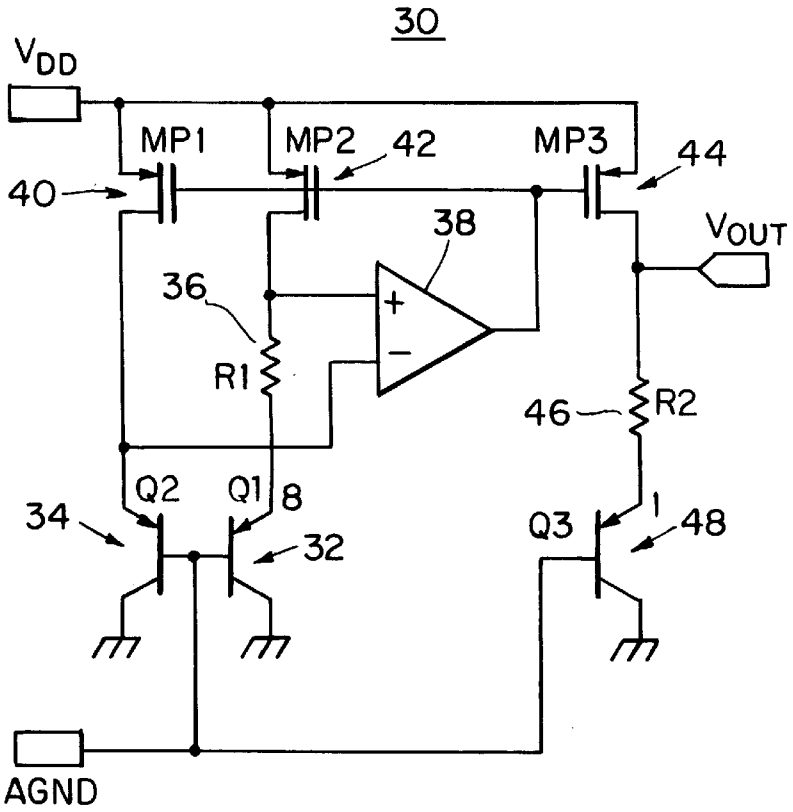
FIG. 2 PRIOR ART
FIG. 2 is a schematic diagram of a prior art continuous time CMOS bandgap reference circuit.

In a standard CMOS process one bipolar device type is available. This is the parasitic substrate device which has its collector at the common wafer potential. In an N-well CMOS process this potential is ground in a single supply design. FIG. 2 shows a continuous time circuit 30 using these substrate PNP transistors 32, 34 with the same scaling techniques of FIG. 1 used to produce a $\Delta V_{BE}$ across resistance 36 and so establish the operating current of the circuit. The amplifier 38 sets up the gate-source bias of transistors 40 and 42 so as to provide this operating current. A further copy of this current is made by transistor 44. This develops a voltage drop across resistance 46 which is added to the $V_{BE}$ of transistor 48 so as to produce a stable bandgap reference voltage. This circuit still has the problem of matching between transistors 32 and 34 and also suffers from poor offset voltage in the CMOS input pair of the amplifier 38. Circuits of this type have been used to make bandgap references on CMOS processes but they lack precision.

Figure 3:
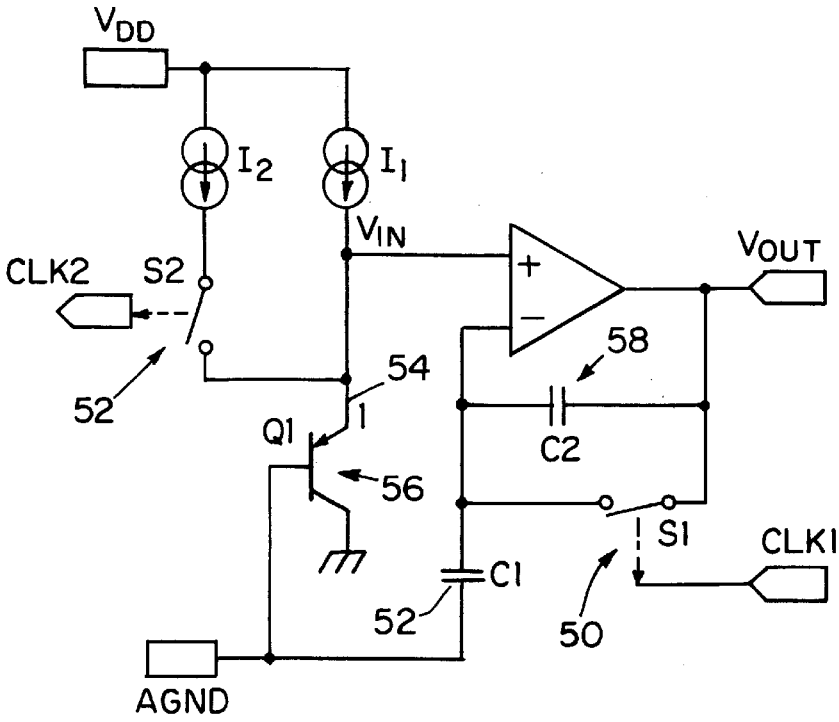
FIG. 3 PRIOR ART
FIG. 3 is a schematic diagram of a prior art switching bandgap reference circuit.

One further prior art example is shown in FIG. 3, described in U.S. Pat. No. 5,563,504, issued to Barrie Gilbert and Shao-Feng Shu, "Switching Bandgap Voltage Reference". This utilizes the fact that in circuits such as A/D converters, the reference voltage is not required to be stable at all times and so may be switched from an auto-zero mode to a valid reference mode and back again as required. This enables the use of only one bipolar transistor operated at different switched currents and so eliminates the problem of mismatch. During the auto-zero mode switch 50 is closed and 52 is open. This sets up the initial conditions of the circuit with $V_{out}=V_{BE1}$ at $I_1$. In the valid reference mode, switch 50 opens first, storing $V_{BE1}$ on capacitor 52. Then switch 52 closes and the emitter 54 of transistor 56 increases to $V_{BE1}$ at $I_1+I_2$. This change in voltage is amplified by a gain determined by the feedback capacitances 52 and 58 and added to the output such that:

$$\begin{aligned} Vout &= V_{BE_1} + (1 + C1/C2) \times (V_{BE_2} - V_{BE_1}) \\ &= V_{BE_2} + (C1/C2) \times (V_{BE_2} - V_{BE_1}) \end{aligned}$$

Figure 3A:
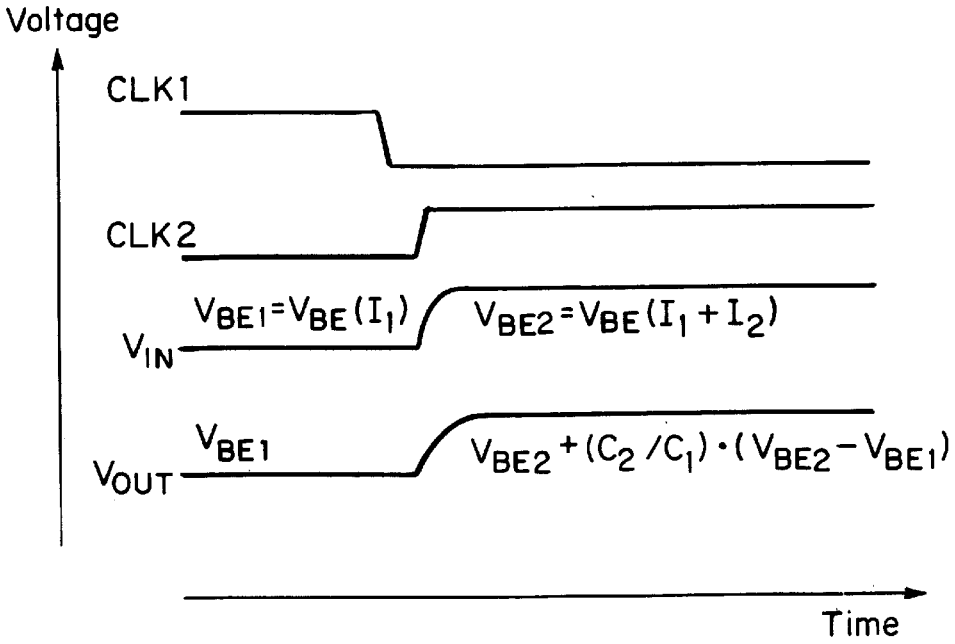
FIG. 3A illustrates waveforms that occur in the circuit of FIG. 3.

This eliminates the need for good matching between the two bipolar transistors 12 and 14 used in FIG. 1 and transistors 32 and 34 used in FIG. 2 but there remains a problem with amplifier offset and noise as the $\Delta V_{BE}$ signal is small. For example with the area ratio 8:1 of transistors 12 and 14, FIG. 1, the $\Delta V_{BE}$ signal at room temperature is only 53 mV approximately. This signal can be increased by using a larger ratio in the currents $I_1$ and $I_2$ but with an increase in power dissipation. Also, the effect is not dramatic due to the log term. For example with N=80 rather than 8, $\Delta V_{BE}$=112 mV. The development of $V_{in}$ and $V_{out}$ in relation to the clock signal CLK1 and CLK2 that operate switches 50 and 52 are shown in FIGS. 3A.

Figure 4:
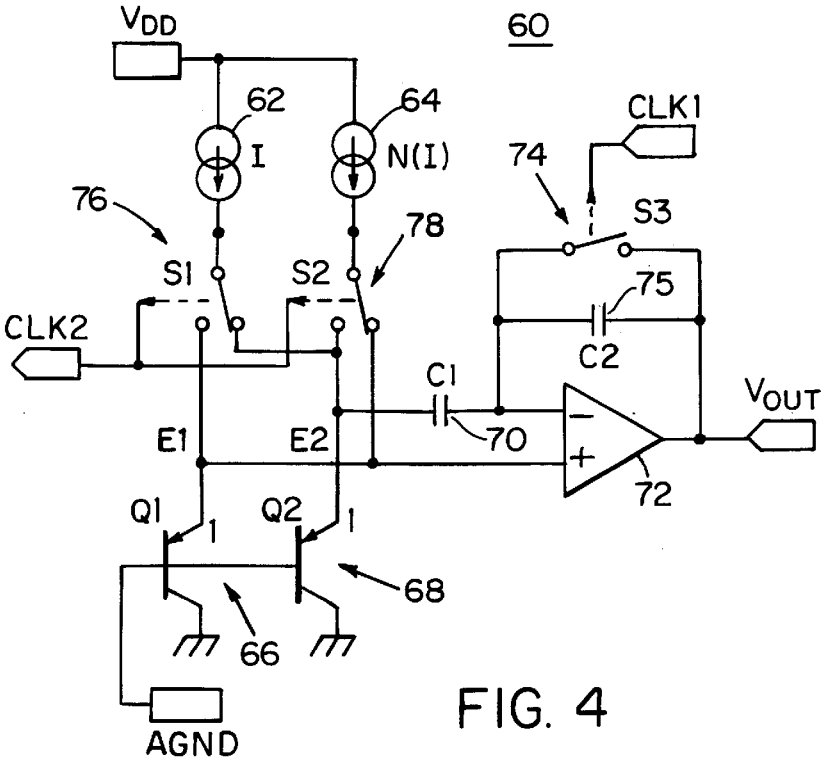
FIG. 4 is a schematic diagram of a switching bandgap reference circuit with compounded $\Delta V_{BE}$ according to this invention.

The new switched current bandgap reference circuit 80 with compounded $\Delta V_{BE}$ is shown in FIG. 4. The purpose of this circuit is to generate a $2\times\Delta V_{BE}$ signal from one switching action of the current sources 62, 64. Two PNP transistors 66, 68 are now used with currents I and N(I) and the current is switched from one to the other so that as one $V_{BE}$ goes from a low to a high value, the other $V_{BE}$ goes from a high to a low value maintaining a constant overall supply current. The resulting two $\Delta V_{BE}$ signals are summed on capacitor 70 and amplified by amplifier 72 as before to produce the required bandgap voltage at the output of amplifier 72. Although two PNP transistors 66, 68 are now used there is no matching requirement between them. Only the $\Delta V_{BE}$ of each transistor at the switched currents is summed with the $V_{BE}$ of transistor 66.

Figure 4A:
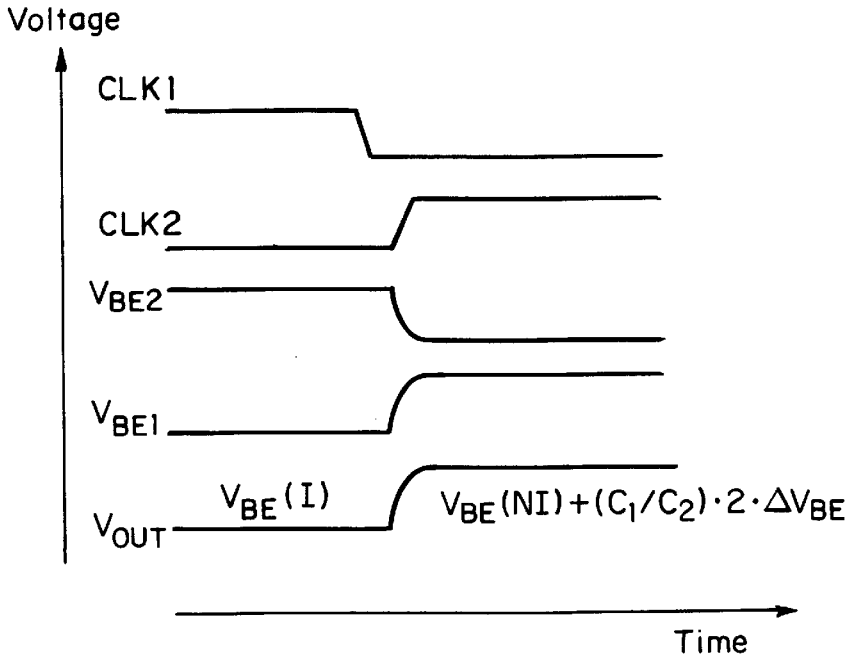
FIG. 4A illustrates waveforms that occur in the circuit of FIG. 4.

For description purposes the various $V_{BE}$'s are designated as follows: $V_{BE1(1)}$ and $V_{BE1(NI)}$, are the $V_{BE}$ of transistor 66 at I and N(I) and $V_{BE2(1)}$ and $V_{BE2(N1)}$ are the $V_{BE}$ of transistor 68 at I and NI. Initially the circuit is in auto-zero with the feedback switch 74 closed, shorting feedback capacitor 75, and with switches 76 and 78 set to the left. Thus the output is at $V_{BE1(1)}$, FIG. 4A, as the amplifier 72 is configured as a voltage follower. The right hand side of capacitor 70 is also at $V_{BE1(1)}$. The left-hand side of capacitor 70 is at $V_{BE2(N1)}$. Switch 74 is now opened, preserving these initial conditions. Switches 76 and 78 are now switched to the right, causing the voltage at the positive terminal of the amplifier 72 to increase by an amount $[V_{BE1(N1)}-V_{BEI(1)}]$. If the left-hand terminal of capacitor 70 were at a fixed voltage then the output would respond to this signal only and the circuit would default to that of FIG. 3. However, as the positive terminal and thereby the right-hand side of capacitor 70 increases by this $\Delta V_{BE1}$, the current in transistor 68 reduces from NI to I causing a drop in voltage of $[V_{BE2(N1)}-V_{BE2(1)}]$ on the left-hand side of capacitor 70. Thus both $\Delta V_{BE}$ terms are summed and amplified to give the following output:

$$
\begin{aligned}
Vout &= V_{BE_1(I)} + [V_{BE_1(NI)} - V_{BE_1(I)}] \times [1 + C1/C2] + \\
&\quad [V_{BE_2(NI)} - V_{BE_2(I)}] \times [C1/C2] \\
&= V_{BE_1(NI)} + [C1/C2] \times [(V_{BE_1(NI)} - V_{BE_1(I)}) + \\
&\quad (V_{BE_2(NI)} - V_{BE_2(I)})].
\end{aligned}
$$

Under nominal conditions, both $\Delta V_{BE}$ signals are equal and the circuit 60 simply doubles this $\Delta V_{BE}$ input signal. This improvement is best illustrated with an example: With a unit current source I=2$\mu$A and N=24 giving a total switching supply current of 50$\mu$A, there is a $\Delta V_{BE}$ signal of 81.65 mV at T=25 degrees. The input signal to the amplifier is then 163.3 mV. To achieve the same input signal level with the circuit of FIG. 3 a much larger ratio would be required: 2$\mu$A and $(24)^2 \times 2\mu$A giving a total switching current of 1152$\mu$A.

Figure 5:
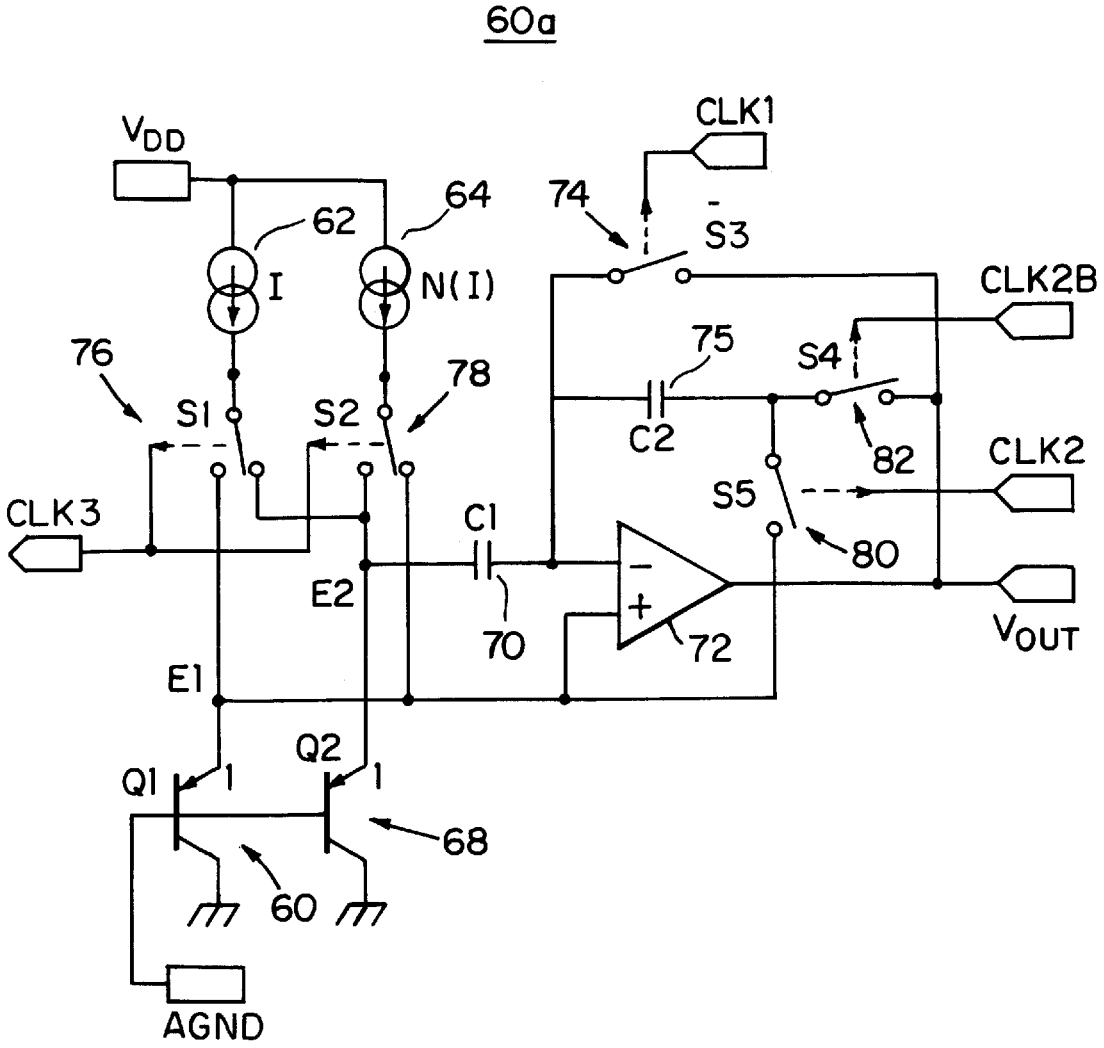
FIG. 5 is a schematic diagram of the circuit of FIG. 4 with amplifier offset cancellation.

As the amplifier 72 is made using MOS input devices, a significant offset voltage must be expected and so offset cancellation circuitry should be included. FIG. 5 shows a well-known technique for offset cancellation sometimes known as correlated-double sampling or simply auto-zero. In auto-zero the feedback switch 74 is closed but the feedback capacitor 75 is no longer connected to the amplifier 72 output as before in FIG. 4. Instead, capacitor 75 is switched to the positive input of the amplifier 72 by switch 80 and so is charged to the amplifier offset voltage. When the circuit switches from auto-zero to the valid reference mode, switch 74 opens first, storing this offset on capacitor 75. Then capacitor 75 is switched back to the amplifier 72 output by switch 82, cancelling the offset error and finally switches 76 and 78 are switched to create the required $\Delta V_{BE}$ signals.

The ratioed current sources are made with a 5×5 array of unit PMOS devices which are laid out with the same care as used in making 8 and 10 bit current-source Digital to Analog converters so the matching performance may be predicted and is well within the requirements of the circuit. The array is surrounded by a full ring of dummy devices with the center PMOS device chosen as the single 2$\mu$A current source. The surrounding 24 devices are wired together to give 48$\mu$A.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A switching bandgap reference circuit with compounded $\Delta V_{BE}$, comprising:

an amplifier having an output, an inverting input and a non-inverting input;

a first PN junction connected to said non-inverting input;

a second PN junction connected to said inverting input through an input capacitor;

a low current source and a high current source;

a switching device for applying in an auto zero mode the low current source to a first terminal of said first PN junction and the high current source to a first terminal of said second PN junction for establishing a $V_{BE1}$ of said first PN junction at both said inputs of said amplifier, and for applying in a valid reference mode the high current source to said first terminal of said first PN junction and the low current source to said first terminal of said second PN junction for establishing a positive $\Delta V_{BE1}$ of said first PN junction to both said inputs of said amplifier and applying a negative $\Delta V_{BE2}$ of said second PN junction to said input capacitor to produce a voltage of $\Delta V_{BE1}$ plus $(-\Delta V_{BE2})$ across said input capacitor;

a feedback capacitor connected between the output and inverting input of said amplifier to define the gain on a combined $\Delta V_{BE}$ voltage to produce a temperature stabilized voltage at the output of said amplifier; and a reset switching device for discharging said feedback capacitor and enabling said amplifier to equalize its inputs in the auto-zero mode.

2. The switching bandgap reference circuit of claim 1 in which said amplifier is an operational amplifier.

3. The switching bandgap reference circuit of claim 1 in which at least one of said first or second PN junctions is included in a diode.

4. The switching bandgap reference circuit of claim 1 in which at least one of said first or second PN junctions is included in a transistor.

5. The switching bandgap reference circuit of claim 1 in which at least one of said first or second PN junctions is included in a bipolar transistor.

6. The switching bandgap reference circuit of claim 1 in which at least one of said first or second PN junctions is included in a parasitic substrate bipolar transistor in a CMOS circuit.

7. The switching bandgap reference circuit of claim 6 in which said transistors include a collector connected to ground.

8. The switching bandgap reference circuit of claim 1 in which said first PN junction has a second terminal connected to a common node to establish the amplifier output voltage relative to that node.

9. The switching bandgap reference circuit of claim 8 in which said common node is ground.

* * * * *